US010211019B2

(12) United States Patent
Roopnarine et al.

(10) Patent No.: US 10,211,019 B2
(45) Date of Patent: Feb. 19, 2019

(54) CIRCUIT BREAKER INCLUDING ROTARY HANDLE

(71) Applicant: ABB Schweiz AG, Baden (CH)

(72) Inventors: Roopnarine, New York, NY (US); Umashankar Shanmugaraj, Andhra Pradesh (IN); Sourabh K. Khedkar, Telangana (IN)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 15/332,678

(22) Filed: Oct. 24, 2016

(65) Prior Publication Data

US 2018/0114662 A1 Apr. 26, 2018

(51) Int. Cl.

| | |
|---|---|
| ***H01H 9/28*** | (2006.01) |
| ***H01H 71/52*** | (2006.01) |
| ***H01H 69/00*** | (2006.01) |
| ***H01H 71/02*** | (2006.01) |
| ***H01H 71/04*** | (2006.01) |
| ***H01H 71/06*** | (2006.01) |

(52) U.S. Cl.

CPC ..... *H01H 71/521* (2013.01); *H01H 69/00* (2013.01); *H01H 71/0221* (2013.01); *H01H 71/04* (2013.01); *H01H 71/06* (2013.01); *H01H 2071/046* (2013.01); *H01H 2221/052* (2013.01)

(58) Field of Classification Search

CPC .. H01H 71/521; H01H 69/00; H01H 71/0221; H01H 71/04; H01H 2221/052

USPC ..... 200/50.24, 43.11

See application file for complete search history.

(56) References Cited

U.S. PATENT DOCUMENTS 2,256,910 A 9/1941 Rowe
4,405,844 A * 9/1983 Dizon ..... H01H 21/06 200/50.12

(Continued)

FOREIGN PATENT DOCUMENTS

EP 0882301 B1 10/1999
EP 2460172 B1 7/2013

OTHER PUBLICATIONS

Office Action from U.S. Appl. No. 15/334,642 dated Aug. 29, 2017, 10 pages.

(Continued)

*Primary Examiner* — Edwin A. Leon
*Assistant Examiner* — Lheiren Mae A Caroc
(74) *Attorney, Agent, or Firm* — Barnes & Thornburg LLP

(57) ABSTRACT

An electrically insulative case includes a door arranged to move between an opened position and a closed position and a rack mechanism arranged to move between an ON position and an OFF position. The electrically insulative case further includes an interlock including a plunger arranged to move between a locked position and an unlocked position. The interlock also includes an engagement mechanism that is coupled to the plunger. The engagement mechanism is arranged to move between a first position in which the engagement mechanism is spaced from the rack mechanism and a second position in which the engagement mechanism is engaged with the rack mechanism. The door is inhibited from moving to the opened position when the plunger is in the locked position. The plunger is arranged to move to the locked position when the engagement mechanism is in the second position and the rack mechanism is in the ON position.

18 Claims, 13 Drawing Sheets

(56) References Cited

U.S. PATENT DOCUMENTS

| | | | | |
|---|---|---|---|---|
| 5,219,070 | A | 6/1993 | Grunert et al. | |
| 5,288,958 | A | 2/1994 | Grunert et al. | |
| 6,566,618 | B2 | 5/2003 | Hamada et al. | |
| 6,969,813 | B1 | 11/2005 | Winslett et al. | |
| 7,361,857 | B2 | 4/2008 | Suh | |
| 7,420,133 | B2 | 9/2008 | Farrow et al. | |
| 7,985,932 | B2 * | 7/2011 | Yasui ..... | E05B 17/22 200/334 |
| 2013/0118293 | A1 | 5/2013 | Sambar | |
| 2015/0103472 | A1 | 4/2015 | Oneufuer et al. | |
| 2015/0221458 | A1 | 8/2015 | Oneufuer et al. | |
| 2018/0114661 | A1 | 4/2018 | Roopnarine et al. | |

OTHER PUBLICATIONS

Office Action from U.S. Appl. No. 15/334,642 dated Apr. 27, 2018, 10 pages.
Office Action from U.S. Appl. No. 15/332,642, dated Oct. 25, 2018, 12 pages.

* cited by examiner

CIRCUIT BREAKER INCLUDING ROTARY HANDLE

BACKGROUND

The field of the disclosure relates generally to circuit breakers and, more particularly, to circuit breakers including rotary handles.

Circuit breakers are often used to protect, in a residential, industrial, utility, or commercial environment, against overcurrent conditions, ground fault conditions, or other system anomalies that are undesirable and require the circuit breaker to interrupt the flow of current through the circuit breaker.

At least some known circuit breakers include an electrically insulative case that encloses at least a portion of the circuit breaker and inhibits current flowing to the exterior of the case. Typically, the case includes a door that allows access to the interior of the case. The door includes a handle that is used to open and close the door. However, access to the interior of the case during operation of the circuit breaker is a safety risk due to the electric current flowing through the circuit breaker. Accordingly, at least some circuit breakers include a handle that is linked to conductive components which interrupt the flow of current through the circuit breaker when the door is opened. In addition, some circuit breakers include interlock mechanisms that inhibit the door opening when the circuit breaker is on. However, some handles and interlock mechanisms operate inconsistently and/or fail. Moreover, the handles and interlock mechanisms increase the cost and time required to assemble the circuit breakers.

BRIEF DESCRIPTION

In one aspect, an electrically insulative case for a circuit breaker is provided. The electrically insulative case includes a door arranged to move between an opened position and a closed position. The electrically insulative case also includes a rack mechanism arranged to move between an ON position and an OFF position. The rack mechanism is arranged to actuate an operating switch of the circuit breaker such that a conductive path is closed when the rack mechanism is in the ON position and is open when the rack mechanism is in the OFF position. The electrically insulative case further includes an interlock arranged to selectively inhibit the door moving between the opened position and the closed position. The interlock includes a plunger and an engagement mechanism. The plunger is arranged to move between a locked position and an unlocked position. The door is inhibited from moving to the opened position when the plunger is in the locked position. The engagement mechanism is coupled to the plunger and is arranged to move between a first position in which the engagement mechanism is spaced from the rack mechanism and a second position in which the engagement mechanism is engaged with the rack mechanism. The plunger is arranged to move to the locked position when the engagement mechanism is in the second position and the rack mechanism is in the ON position.

In another aspect, a circuit breaker is provided. The circuit breaker includes a door arranged to move between an opened position and a closed position and an operating switch arranged to move between an ON position and an OFF position. A conductive path is closed when the operating switch is in the ON position and is open when the operating switch is in the OFF position. The circuit breaker also includes a gear train mechanism coupled to the operating switch. The gear train mechanism is arranged to induce the operating switch to move between the ON position and the OFF position. The circuit breaker further includes an interlock that is arranged to selectively inhibit the door from moving between the opened position and the closed position. The interlock includes a plunger and an engagement mechanism. The plunger is arranged to move between a locked position and an unlocked position. The door is inhibit from moving to the opened position when the plunger is in the locked position. The engagement mechanism is coupled to the plunger and is arranged to move between a first position in which the engagement mechanism is spaced from the gear train mechanism and a second position in which the engagement mechanism is engaged with the gear train mechanism. The plunger is arranged to move to the locked position when the engagement mechanism is in the second position and the operating switch is in the ON position.

In yet another aspect, a method of manufacturing a circuit breaker is provided. The method includes coupling a door to an electrically insulative case. The door is arranged to move between an opened position and a closed position. The method also includes coupling a handle to the door to enable an operator to move the door between the opened position and the closed position and coupling a gear train mechanism to the handle. The gear train mechanism includes a rack mechanism that is arranged to actuate an operating switch of the circuit breaker such that a conductive path is closed when the rack mechanism is in an ON position and is open when the rack mechanism is in an OFF position. The method further includes coupling a plunger to the door. The plunger is arranged to move between a locked position and an unlocked position. The door is inhibited from moving to the opened position when the plunger is in the locked position. The method also includes coupling an engagement mechanism to the plunger. The engagement mechanism arranged to move between a first position in which the engagement mechanism is spaced from the rack mechanism and a second position in which the engagement mechanism is engaged with the rack mechanism. The plunger is arranged to move to the locked position when the engagement mechanism is in the second position and the rack mechanism is in the ON position.

BRIEF DESCRIPTION OF THE DRAWINGS

These and other features, aspects, and advantages of the present disclosure will become better understood when the following detailed description is read with reference to the accompanying drawings in which like characters represent like parts throughout the drawings, wherein.

Unless otherwise indicated, the drawings provided herein are meant to illustrate features of embodiments of the disclosure. These features are believed to be applicable in a wide variety of systems including one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "substantially," and "approximately," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Exemplary embodiments of circuit breakers and methods of manufacturing circuit breakers are described herein. The circuit breakers generally include a handle that rotates relative to an electrically insulative case. The handle is coupled to a gear train mechanism, which includes a drive gear, a plurality of pinions, and a sliding rack. In some embodiments, the plurality of pinions are positioned within an outer circumference of the drive gear to reduce the space occupied by the gear train mechanism. The gear train mechanism translates the rotational movement of the handle into linear movement of the sliding rack. The sliding rack causes actuation of a switch of the circuit breaker. In some embodiments, the handle includes a visual indicator mechanism to indicate the operating status of the circuit breaker. In further embodiments, the circuit breaker includes an interlock that selectively engages a biasing mechanism. Also, in some embodiments, the circuit breaker includes a gear lock mechanism that directly engages a drive gear.

Figure 1A:
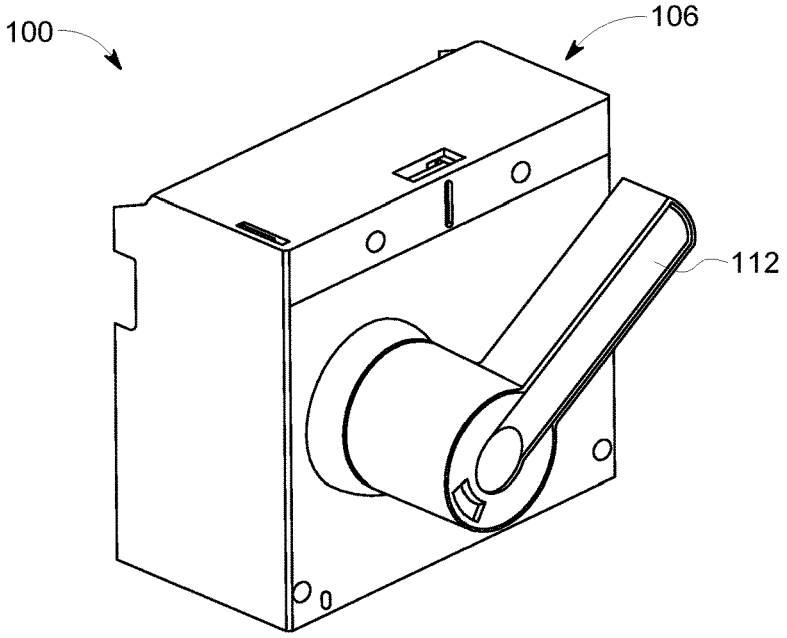
FIG. 1A is a perspective view of a portion of a circuit breaker assembly.
Figure 1B:
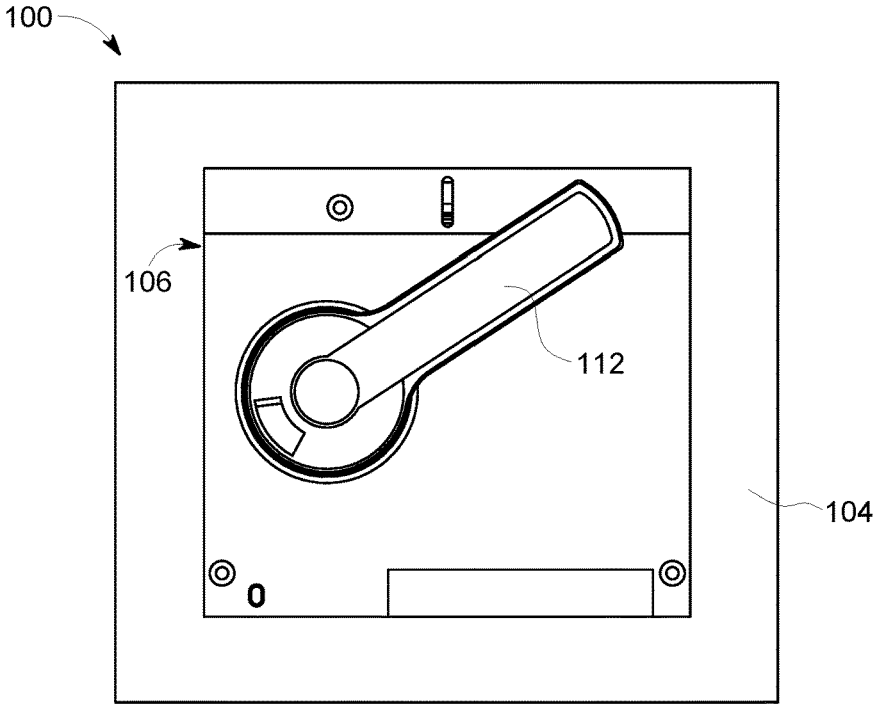
FIG. 1B is a front view of the circuit breaker assembly shown in FIG. 1A.

FIG. 1A is a perspective view of a portion of a circuit breaker 100. FIG. 1B is a front view of circuit breaker assembly 100. In the exemplary embodiment, circuit breaker 100 is coupled to a circuit such that circuit breaker 100 controls flow of electric current through the circuit. A case 102 (shown in FIG. 1C) electrically insulates circuit breaker 100 such that electrical current is inhibited from passing through case 102 to the surrounding environment. Circuit breaker 100 includes any components that enable circuit breaker 100 to operate as described herein. For example, in some embodiments, circuit breaker 100 includes a load strap (not shown), a line strap (not shown), a rotor assembly (not shown), and an operating mechanism (not shown).

Figure 1C:
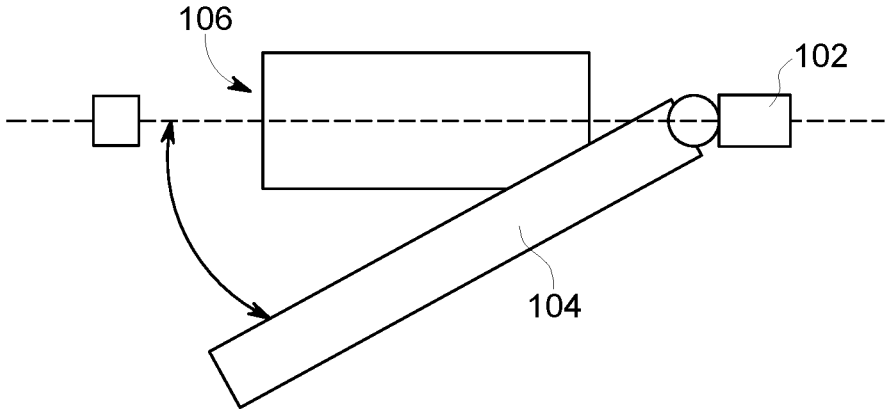
FIG. 1C is a schematic view of a door of the circuit breaker assembly shown in FIG. 1A that is positionable between an opened position and a closed position.

FIG. 1C is a schematic view of a door 104 that is positionable between an opened position and a closed position. When door 104 is in the opened position, an interior of case 102 is accessible to operators for inspection and maintenance of circuit breaker 100. In the exemplary embodiment, door 104 at least partially circumscribes a handle assembly 106. In operation, door 104 is substantially parallel to handle assembly 106 when door 104 is in the closed position and door 104 is angled relative to handle assembly 106 when door 104 is in the opened position. In alternative embodiments, circuit breaker 100 includes any door 104 that enables circuit breaker 100 to operate as described herein.

Figure 2A:
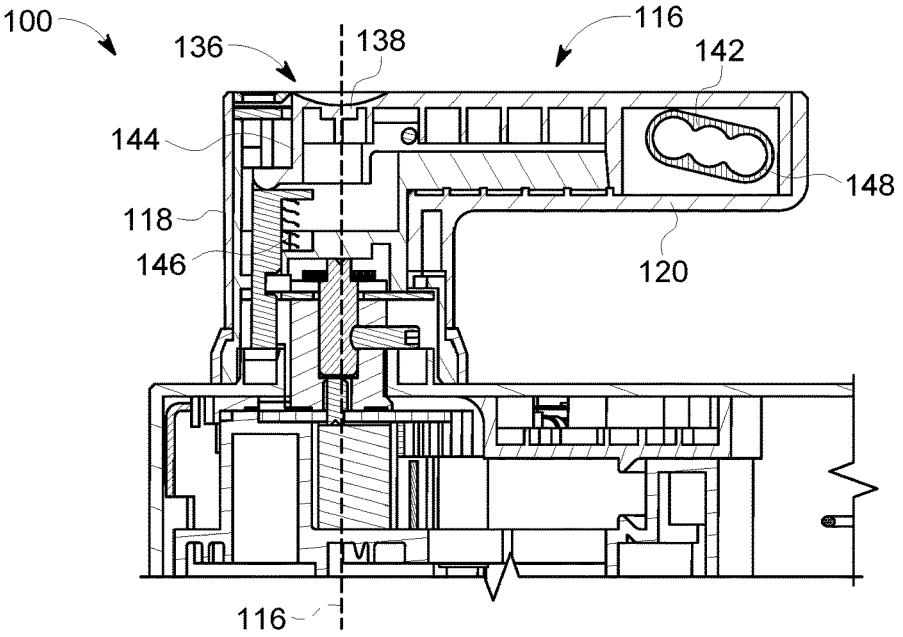
FIG. 2A is a section view of the circuit breaker assembly shown in FIG. 1A.
Figure 2B:
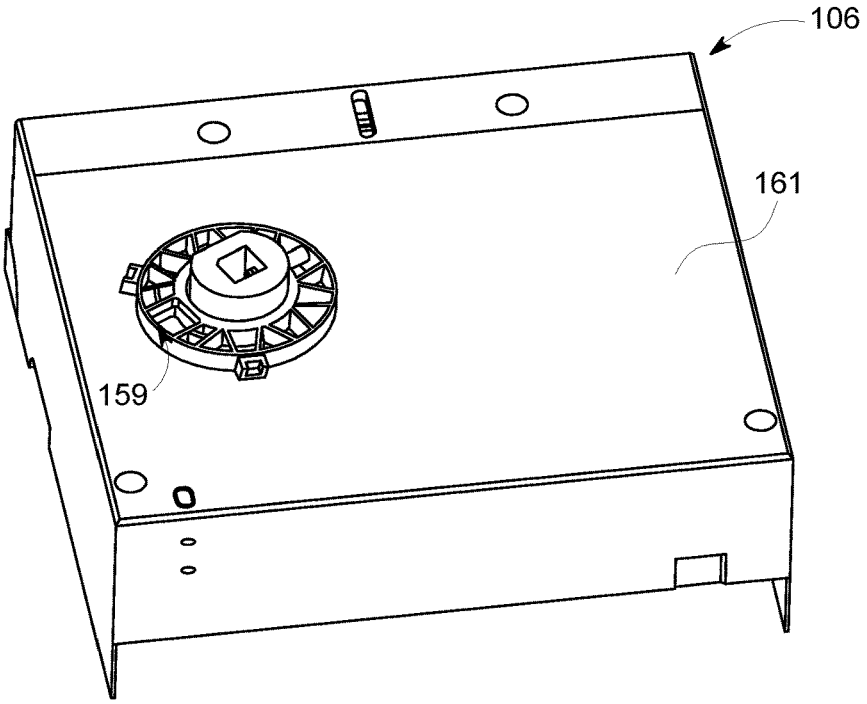
FIG. 2B is a perspective view of a portion of a handle assembly of the circuit breaker assembly shown in FIG. 1A.

FIG. 2A is a section view of circuit breaker 100. FIG. 2B is a perspective view of a portion of handle assembly 106. Circuit breaker 100 further includes a handle 112 coupled to door 104 for positioning door 104 between the opened and closed positions. Handle 112 rotates about an axis 116 extending through handle 112. In the exemplary embodiment, handle 112 includes a hub 118 and a grip portion 120. Axis 116 extends through the center of hub 118. Grip portion 120 extends from hub 118 in a direction substantially perpendicular to axis 116. In alternative embodiments, circuit breaker 100 includes any handle 112 that enables circuit breaker 100 to operate as described herein.

Figure 3:
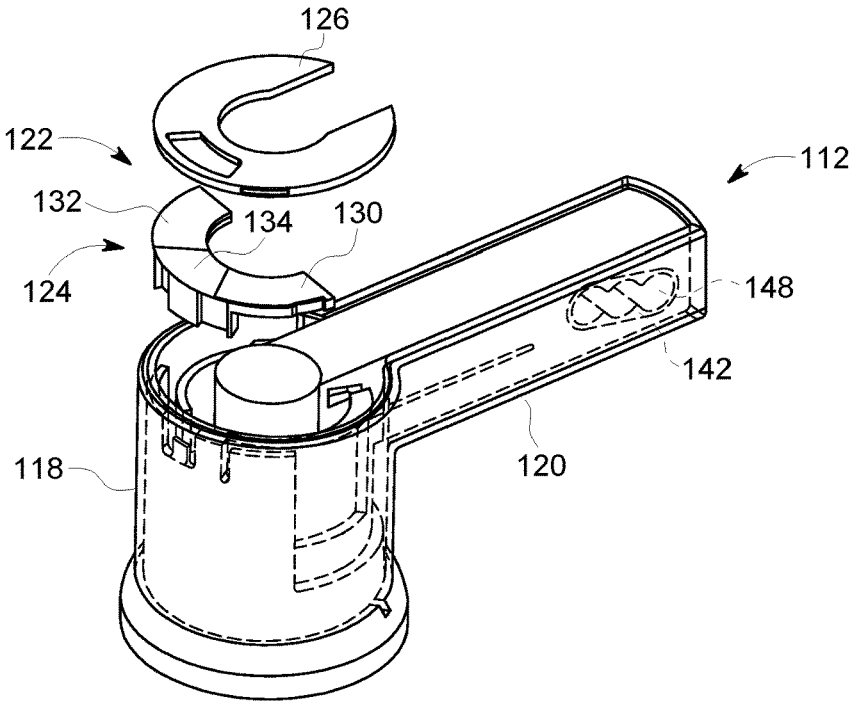
FIG. 3 is an exploded perspective view of a handle of the circuit breaker assembly shown in FIG. 1A.

FIG. 3 is an exploded view of handle 112. In the exemplary embodiment, handle 112 includes an indicator mechanism 122. Indicator mechanism 122 includes an indicator panel 124 and an indicator cover 126. Indicator panel 124 is positioned at least partially within hub 118 of handle 112 and includes a plurality of indicators relating to the position of handle 112. Indicator cover 126 at least partially covers indicator panel 124. A portion of indicator panel 124 is visible through an opening 128 in indicator cover 126. In some embodiments, opening 128 is covered by a transparent material. In alternative embodiments, handle 112 includes any indicator mechanism 122 that enables circuit breaker 100 to operate as described herein. For example, in some embodiments, opening 128 is omitted and indicator cover 126 extends over only a portion of indicator panel 124.

In the exemplary embodiment, indicator panel 124 is inhibited from rotating and indicator cover 126 moves with handle 112. Accordingly, the portion of indicator panel 124 that is visible through opening 128 changes as indicator cover 126 rotates with handle 112. In alternative embodiments, indicator panel 124 and/or indicator cover 126 move in any manner that enables indicator mechanism 122 to operate as described herein. For example, in some embodiments, indicator panel 124 moves and indicator cover 126 remains stationary.

Also, in the exemplary embodiment, the visible portion of indicator panel 124 includes indicators that are associated with positions of handle 112. Specifically, in the illustrated embodiment, indicator panel 124 includes an ON position indicator 130, an OFF position indicator 132, and a TRIP position indicator 134. In some embodiments, indicator panel 124 is colored. For example, in some embodiments, ON position indicator 130 is green, OFF position indicator 132 is red, and TRIP position indicator 134 is white. In alternative embodiments, indicator panel 124 includes any indicators that enable circuit breaker 100 to operate as described herein.

In reference to FIGS. 2-3, handle 112 further includes a locking mechanism 136. Locking mechanism 136 includes an actuator 138, a pivoting wall 140, a lock engagement portion 142, a lever 144, and a biasing mechanism 146. In operation, when an operator presses actuator 138 and applies a force sufficient to overcome the biasing force of biasing mechanism 146, pivoting wall 140 moves and exposes lock engagement portion 142. Lock engagement portion 142 defines openings 148 configured to receive a lock (not shown). In addition, when actuator 138 is depressed, lever 144 engages a stationary portion of handle assembly 106 and inhibits rotation of handle 112. In particular, a portion of lever 144 extends into a pocket 159 of a front cover 161 of handle assembly 106 when actuator 138 is depressed. A continual force on actuator 138 is required to overcome biasing mechanism 146 and maintain lever 144 in an engaged position. Alternatively, a lock (not shown) is positioned in openings 148 of lock engagement portion 142 to inhibit lever 144 moving out of the engaged position when the force on actuator 138 is removed. In alternative embodiments, handle 112 includes any locking mechanism 136 that enables circuit breaker 100 to operate as described herein.

Figure 4:
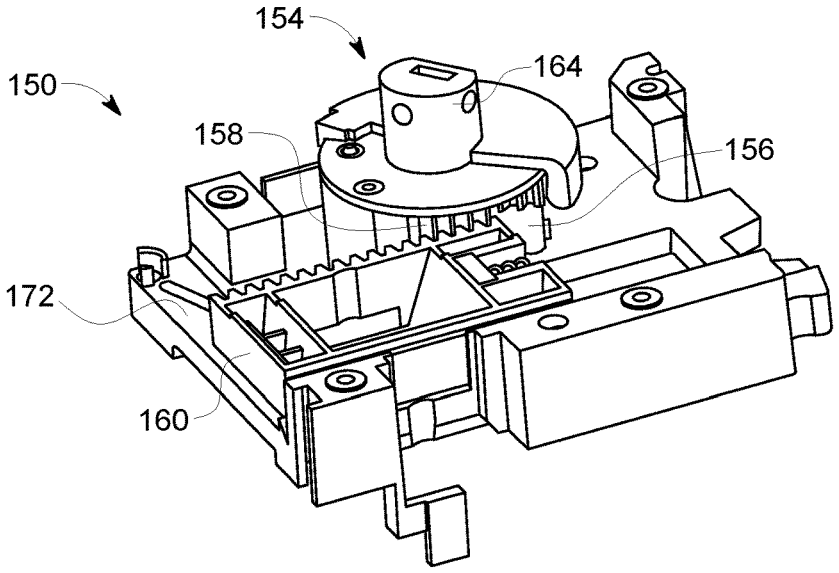
FIG. 4 is a perspective view of a gear train mechanism of the circuit breaker assembly shown in FIG. 1A.
Figure 5:
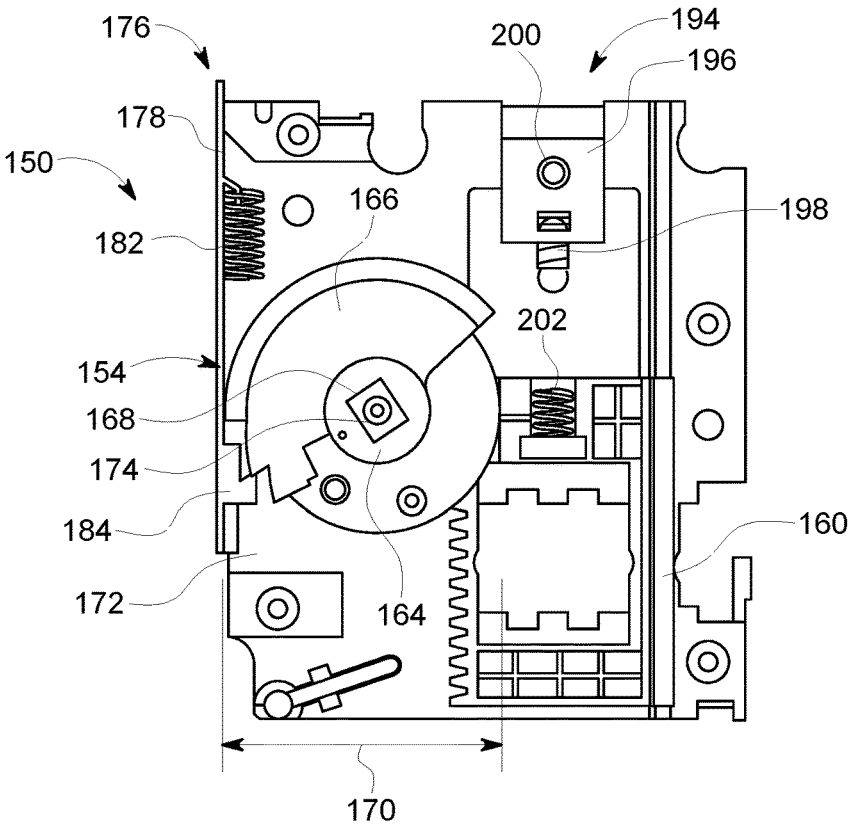
FIG. 5 is a side view of the gear train mechanism shown in FIG. 4.
Figure 6:
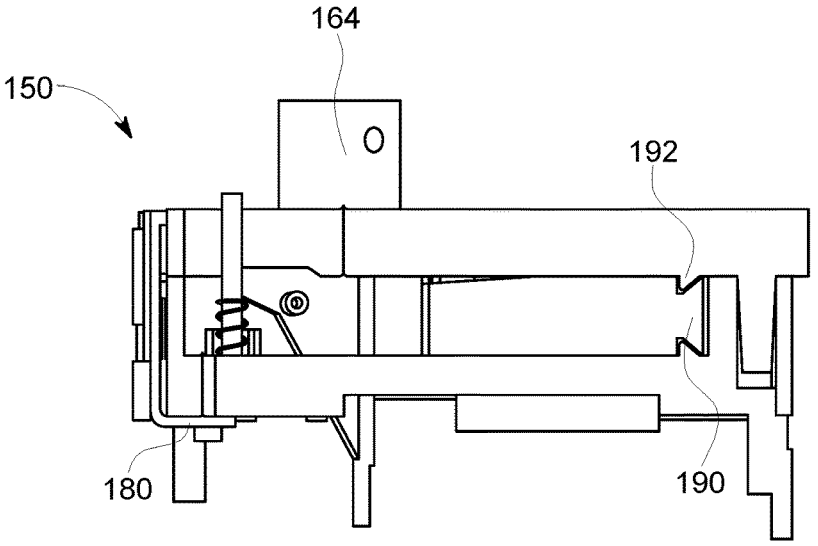
FIG. 6 is a bottom view of the gear train mechanism shown in FIG. 4.

FIG. 4 is a perspective view of a gear train mechanism 150 of circuit breaker 100. FIG. 5 is a side view of gear train mechanism 150. FIG. 6 is a bottom view of gear train mechanism 150. Gear train mechanism 150 is drivingly coupled to handle 112 by a drive shaft 152 (shown in FIG. 11). Gear train mechanism 150 includes a drive gear 154, a first pinion 156, a second pinion 158, a sliding rack 160, and a gear train housing 162. Drive gear 154 includes a hub 164 and an engagement portion 166. Hub 164 defines an opening 168 for receiving drive shaft 152 (shown in FIG. 11). Opening 168 is at least partially rectangular such that rotation of drive shaft 152 (shown in FIG. 11) in opening 168 causes drive gear 154 to rotate. In alternative embodiments, gear train mechanism 150 operates in any manner that enables circuit breaker 100 to operate as described herein.

In the exemplary embodiment, first pinion 156 includes teeth that engage teeth on engagement portion 166 of drive gear 154. Second pinion 158 includes teeth that engage the teeth of first pinion 156. Accordingly, rotation of drive gear 154 causes rotation of first pinion 156 and second pinion 158. In alternative embodiments, gear train mechanism 150 includes any pinions 156, 158 that enable circuit breaker 100 to operate as described herein. For example, in some embodiments, gear train mechanism 150 includes three or more pinions 156, 158.

In the exemplary embodiment, engagement portion 166 is a semicircle having a diameter 170. First pinion 156 and second pinion 158 are sized and positioned such that first pinion 156 and second pinion 158 are encompassed within the circumference of engagement portion 166 when first pinion 156 and second pinion 158 are engaged with engagement portion 166. As a result, gear train mechanism 150 has a reduced size. In alternative embodiments, drive gear 154, first pinion 156, and second pinion 158 are any size and shape that enable gear train mechanism 150 to operate as described herein.

In the exemplary embodiment, drive gear 154, first pinion 156, and second pinion 158 are rotatably coupled to gear train housing 162. Specifically, drive gear 154, first pinion 156, and second pinion 158 are supported on a mounting plate 172 by a plurality of pins 174. In alternative embodiments, drive gear 154, first pinion 156, and second pinion 158 are coupled to gear train housing 162 in any manner that enables circuit breaker 100 to operate as described herein. In further embodiments, gear train housing 162 is omitted.

Moreover, in the exemplary embodiment, second pinion 158 engages rack 160 such that rotation of second pinion 158 causes rack 160 to move linearly. In particular, teeth of second pinion 158 engage teeth of rack 160. Accordingly, when drive gear 154, first pinion 156, and second pinion 158 rotate, rack 160 moves linearly. Rack 160 moves between an ON position and an OFF position and is configured to engage a switch (not shown) of circuit breaker 100. In alternative embodiments, rack 160 moves in any manner that enables circuit breaker 100 to operate as described herein.

In reference to FIG. 5, circuit breaker 100 further includes a gear lock mechanism 176. Gear lock mechanism 176 includes an arm 178, a coupler 180, and a biasing member 182. Arm 178 is coupled to gear train housing 162 and includes a gear engagement portion 184. Arm 178 is movable between a locked position and an unlocked position. Coupler 180 is configured to couple arm 178 to gear train housing 162 such that arm 178 is retained in the unlocked position. In particular, coupler 180 includes a fastener extending through an opening in arm 178 to secure arm 178 to mounting plate 172. When coupler 180 is removed, arm 178 is free to move between the locked position and the unlocked position. In the exemplary embodiment, arm 178 moves between the locked position and the unlocked position when door 104 is moved between opened and closed positions. In particular, arm 178 moves toward the unlocked position when door 104 is closed and towards the locked position when door 104 is opened. In the illustrated embodiment, when door 104 is opened, biasing member 182 biases arm 178 towards the locked position and arm 178 is allowed to extend beyond door 104. When door 104 is closed, arm 178 is inhibited from extending beyond door 104 and arm 178 is moved towards the unlocked position. In the unlocked position, gear engagement portion 184 is spaced from drive gear 154. In the locked position, gear engagement portion 184 directly engages drive gear 154 and inhibits handle moving to the ON position. The direct engagement between gear lock mechanism 176 and drive gear 154 reduces the number of parts required to assemble circuit breaker 100. In addition, gear lock mechanism 176 has increased reliability compared to at least some known locking mechanisms. In alternative embodiments, handle assembly 106 (shown in FIG. 1C) includes any gear lock mechanism 176 that enables circuit breaker 100 to operate as described herein.

Figure 7:
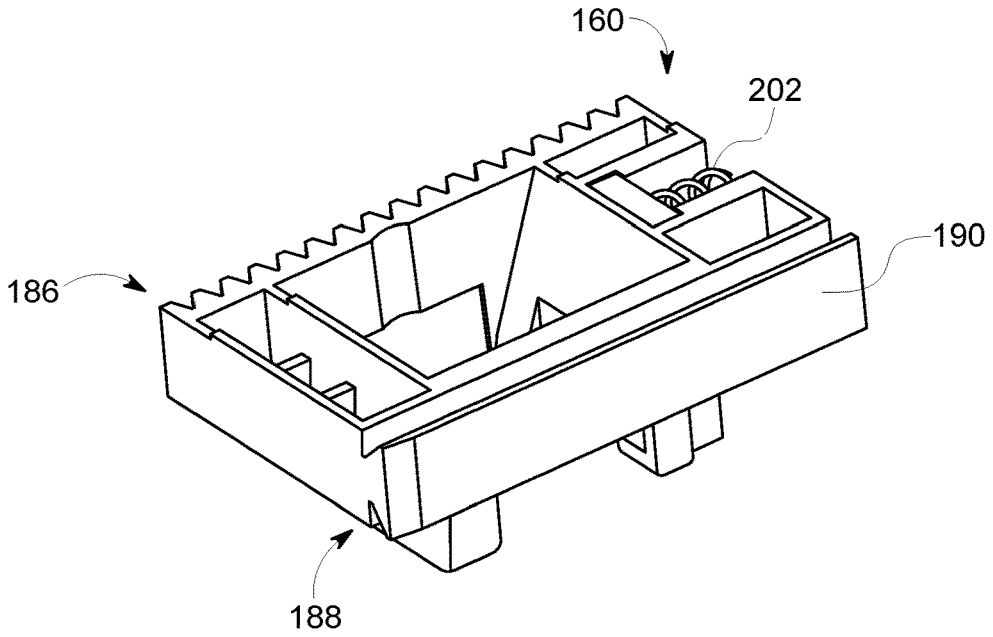
FIG. 7 is a perspective view of a sliding rack of the circuit breaker assembly shown in FIG. 1A.

FIG. 7 is a perspective view of rack 160. Rack 160 includes a toothed portion 186 and a slide portion 188. Toothed portion 186 includes a plurality of teeth that engage the teeth of second pinion 158 (shown in FIG. 4). Slide portion 188 is movably coupled to case 102 (shown in FIG. 1C) to enable rack 160 to move linearly relative to case 102.

In the exemplary embodiment, rack 160 is substantially rectangular and has a plurality of orthogonal sides. Toothed portion 186 and slide portion 188 are positioned on opposite sides of rack 160. Moreover, toothed portion 186 and slide portion 188 are substantially parallel and facilitate linear movement of rack 160 in response to rotation of pinions 156, 158. In alternative embodiments, rack 160 has any shape that enables rack 160 to operate as described herein.

In reference to FIG. 6, slide portion 188 includes a projection 190 that is received at least partially by a dovetail groove 192 in gear train housing 162. In alternative embodiments, rack 160 is coupled to gear train housing 162 in any manner that enables gear train mechanism 150 to operate as described herein.

Figure 8:
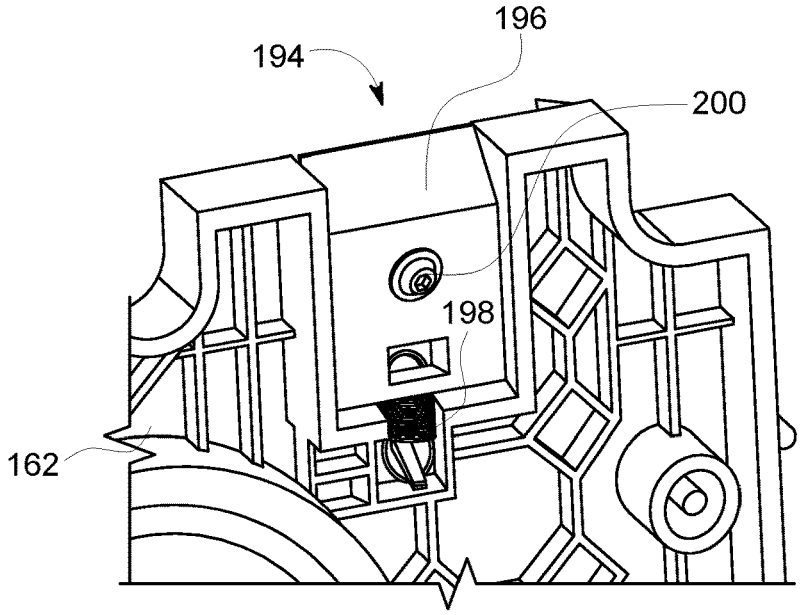
FIG. 8 is a perspective view of a portion of the circuit breaker assembly shown in FIG. 1A with a plunger retained in a first position by a biasing member.
Figure 9:
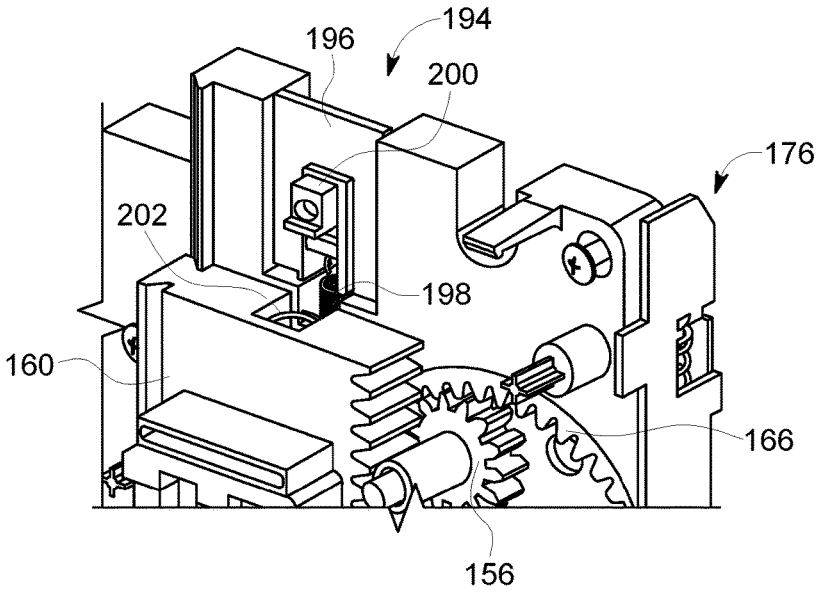
FIG. 9 is a perspective view of a portion of the circuit breaker assembly shown in FIG. 1A with a rack spaced from the plunger.
Figure 10A:
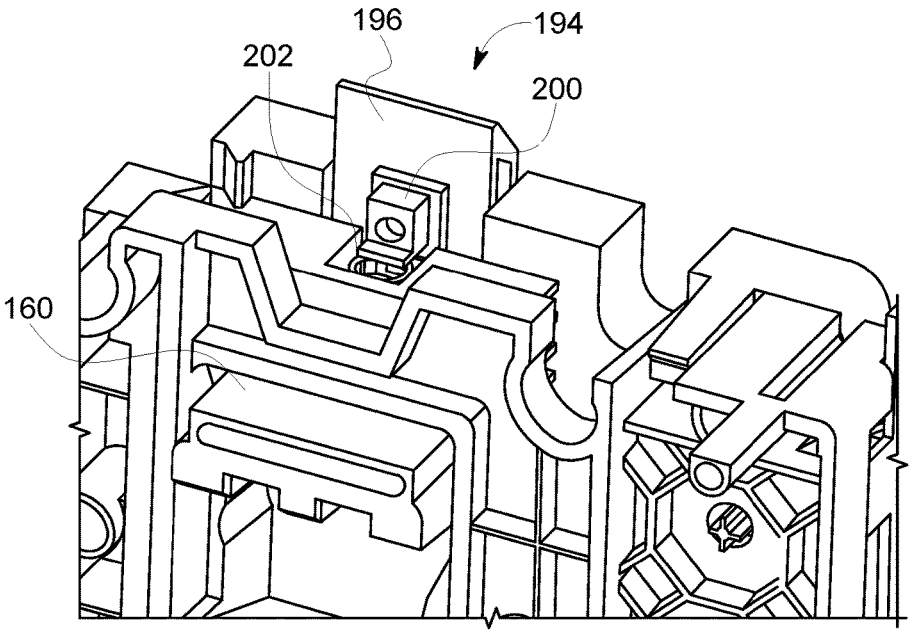
FIG. 10A is a perspective view of a portion of the circuit breaker assembly shown in FIG. 1A with the rack in an ON position and the plunger in a second position.
Figure 10B:
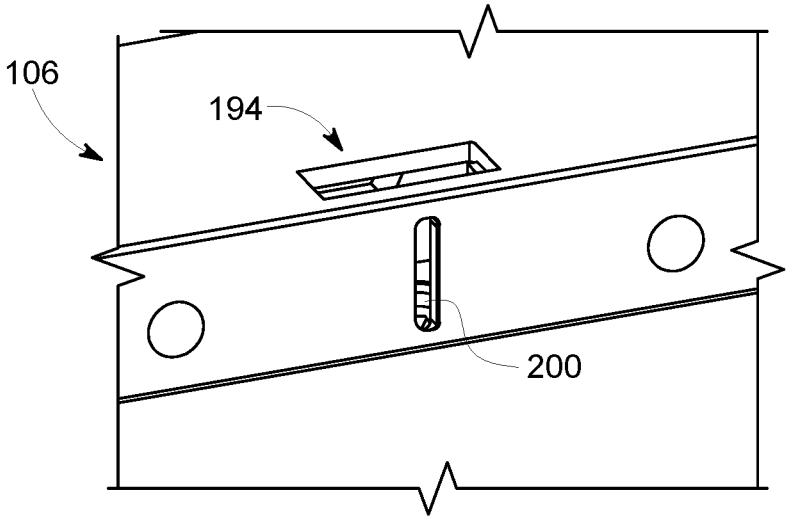
FIG. 10B is a perspective view of a portion of the circuit breaker assembly shown in FIG. 1A with the plunger in the first position.
Figure 10C:
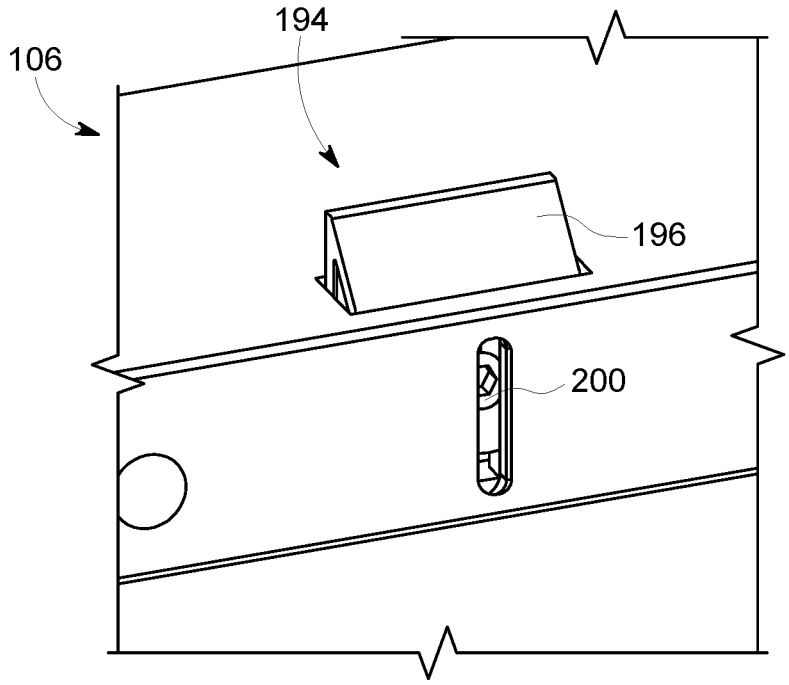
FIG. 10C is a perspective view of a portion of the circuit breaker assembly shown in FIG. 1A with the plunger in the second position.

FIG. 8 is a perspective view of an interlock mechanism 194 of circuit breaker 100 with a plunger 196 retained in a first position by a plunger biasing member 198. FIG. 9 is a perspective view of a portion of circuit breaker 100 with rack 160 spaced from plunger 196. FIG. 10A is a perspective view of a portion of circuit breaker 100 with rack 160 in an ON position and plunger 196 in a second position. FIG. 10B is a perspective view of a portion of circuit breaker 100 with plunger 196 in the first position. FIG. 10C is a perspective view of a portion of circuit breaker 100 with plunger 196 in the second position. Interlock mechanism 194 includes plunger 196, plunger biasing member 198, and an engagement mechanism 200. Plunger 196 is movably coupled to door 104 such that plunger 196 moves between the first position and the second position. In the first position (shown in FIGS. 1A, 8, 10A), plunger 196 does not extend on the exterior of handle assembly 106. In the second position (shown in FIGS. 10A and 10B), plunger 196 extends from handle assembly 106 and engages a portion of door 104 (shown in FIG. 1B). Accordingly, interlock mechanism 194 selectively inhibits door 104 (shown in FIG. 1B) moving between the opened and closed positions. In alternative embodiments, circuit breaker 100 includes any interlock mechanism 194 that enables circuit breaker 100 to operate as described herein.

In the exemplary embodiment, plunger biasing member 198 biases plunger 196 towards the first position. In particular, plunger biasing member 198 extends between and is coupled to plunger 196 and gear train housing 162. Engagement mechanism 200 extends through an opening in plunger 196 and is movable between a first position and a second position. In the first position, engagement mechanism 200 is at least partially concealed in plunger 196 such that engagement mechanism 200 does not engage rack 160. In the second position, engagement mechanism 200 extends from plunger 196 and engages rack 160 when rack 160 is in the ON position. In alternative embodiments, interlock mechanism 194 includes any engagement mechanism 200 that enables circuit breaker 100 to operate as described herein.

Also, in the exemplary embodiment, gear train mechanism 150 further includes a biasing mechanism 202 to bias plunger 196 to the second position. Biasing member 202 is coupled to rack 160. Biasing member 202 is spaced from plunger 196 when rack 160 is in the OFF position and engages engagement mechanism 200 when engagement mechanism 200 is in the second position and rack 160 is in the ON position. Moreover, biasing mechanism 202 has a biasing force that is greater than the biasing force of plunger biasing member 198. Accordingly, biasing mechanism 202 biases plunger 196 to the second position when engagement mechanism 200 is in the second position and rack 160 is in the ON position. To manually override plunger 196, an operator applies a force to plunger 196 that is greater than the biasing force of biasing mechanism 202.

As shown in FIGS. 10A and 10B, interlock mechanism 194 is accessible through an opening 204 in handle assembly 106 to allow an operator to move plunger 196 between the first position and the second position. For example, when plunger 196 is in the second position, an operator moves plunger 196 by inserting an object into opening 204 and applying a force to a portion of interlock mechanism 194, such as engagement mechanism 200 and/or plunger 196, that is greater than the biasing force of biasing mechanism 202. Opening 204 has an elongate slot shape to allow an operator to move plunger 196 a distance. In alternative embodiments, plunger 196 is positioned in any manner that enables circuit breaker 100 to operate as described herein.

Moreover, in the exemplary embodiment, engagement mechanism 200 is accessible through opening 204 in handle assembly 106 to allow an operator to move engagement mechanism 200 between the first position and the second position. In the exemplary embodiment, an operator moves engagement mechanism 200 by turning a screw. As a result, engagement mechanism 200 will engage biasing mechanism 202 and plunger 196 will move to the second position when rack 160 is in the ON position. In alternative embodiments, engagement mechanism 200 is positioned in any manner that enables circuit breaker 100 to operate as described herein.

Figure 11:
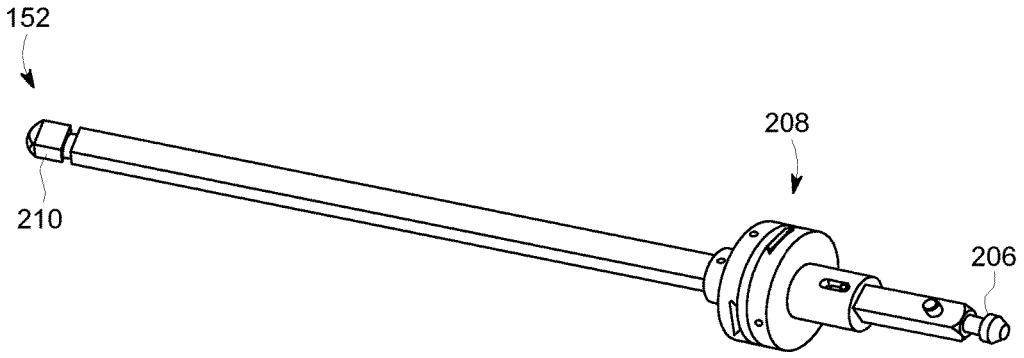
FIG. 11 is a perspective view of a drive shaft.

FIG. 11 is a perspective view of a drive shaft 152. Drive shaft 152 is configured to extend between handle 112 and drive gear 154 to drivingly couple handle 112 and drive gear 154. Drive shaft 152 includes a handle engagement portion 206, a flexible coupling 208, and a drive gear engagement portion 210. Drive gear engagement portion 210 and handle engagement portion 206 are disposed on opposite ends of drive shaft 152. Flexible coupling 208 is positioned between drive gear engagement portion 210 and handle engagement portion 206 and allows flexing and/or movement of drive gear engagement portion 210 relative to handle engagement portion 206 to accommodate misalignment of drive gear 154 and handle 112.

Figure 12:
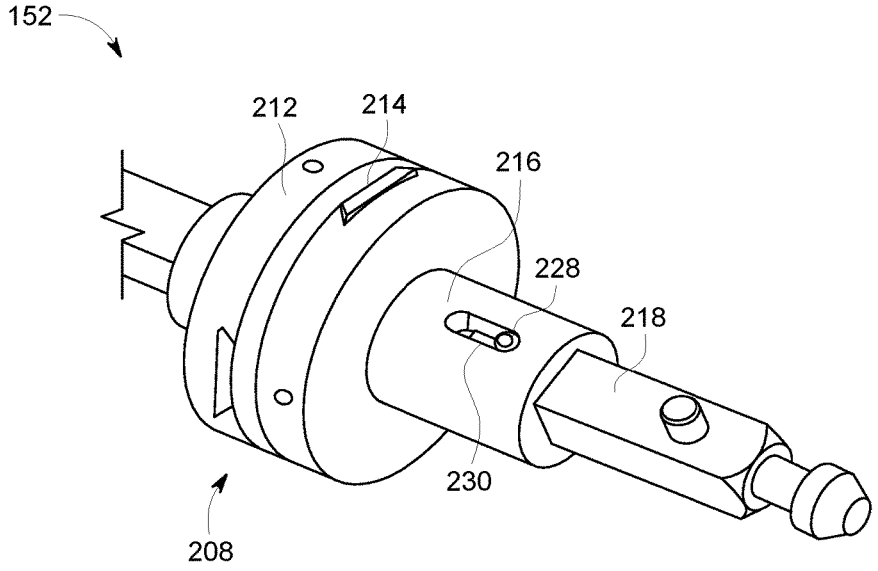
FIG. 12 is an enlarged perspective view of a portion of the drive shaft shown in FIG. 11.
Figure 13:
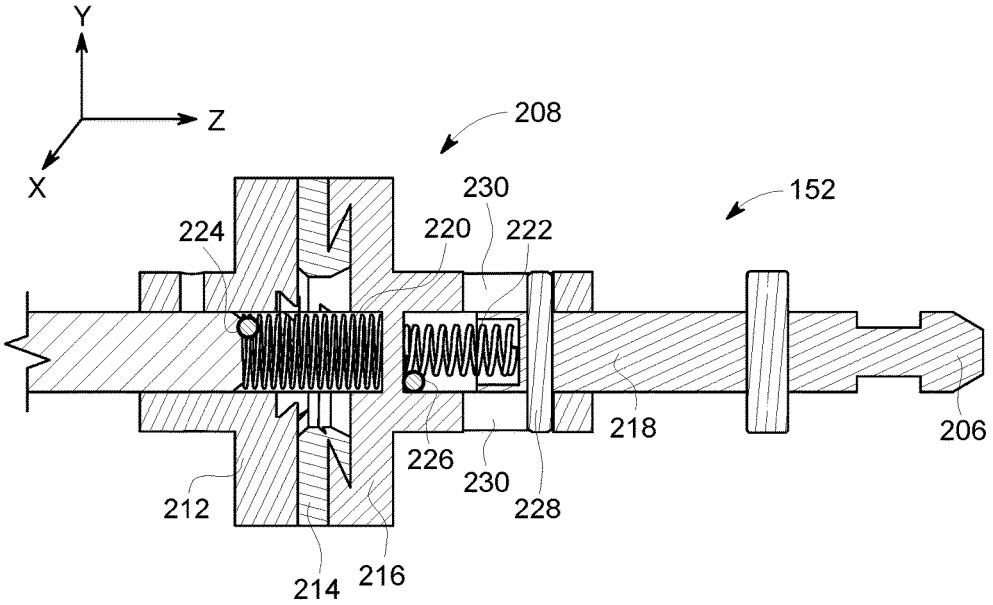
FIG. 13 is a section view of the drive shaft shown in FIG. 11.

FIG. 12 is an enlarged perspective view of flexible coupling 208 of drive shaft 152. FIG. 13 is a sectional view of drive shaft 152. FIG. 13 includes an X-axis, a Y-axis and, a Z-axis for reference during the following description. Flexible coupling 208 includes a first portion 212, a second portion 214, a third portion 216, a fourth portion 218, a first resilient member 220, a second resilient member 222, a first lock pin 224, and a second lock pin 226. First portion 212, second portion 214, third portion 216, and fourth portion 218 are coupled together in a series and allow freedom of movement of drive shaft 152 in the X-direction, the Y-direction, and the Z-direction. In particular, first portion 212 is coupled to second portion 214 such that first portion 212 and second portion 214 are free to move in the X-direction relative to each other. Second portion 214 is coupled to third portion 216 such that second portion 214 and third portion 216 are free to move in the Y-direction relative to each other. First resilient member 220 extends through second portion 214 and provides a biasing force to resist movement of first portion 212, second portion 214, and third portion 216 in the X-direction and the Y-direction. Accordingly, first portion 212, second portion 214, third portion 216, and first resilient member 220 provide compensation for misalignment of drive shaft 152 in the X-direction and the Y-direction.

Third portion 216 is coupled to fourth portion 218 such that third portion 216 and fourth portion 218 are free to move in the Z-direction relative to each other. Second resilient member 222 extends through third portion 216 and fourth portion 218 and provides a biasing force to resist movement of third portion 216 and fourth portion 218 in the Z-direction. Accordingly, third portion 216, fourth portion 218, and second resilient member 222 provide compensation for misalignment of drive shaft 152 in the Z-direction.

In the exemplary embodiment, first portion 212, second portion 214, third portion 216, and fourth portion 218 are coupled together by interlocking grooves and projections that allow sliding movement of first portion 212, second portion 214, third portion 216, and fourth portion 218 in the respective directions. In particular, first portion 212, second portion 214, and third portion 216 form tongue and groove joints. Fourth portion 218 is received within third portion 216 and includes a pin 228 that extends through slots 230 in third portion 216. In alternative embodiments, first portion 212, second portion 214, third portion 216, and fourth portion 218 are coupled together in any manner that enables circuit breaker 100 to operate as described herein.

Also, in the exemplary embodiment, first lock pin 224 extends adjacent first portion 212 and first resilient member 220. Second lock pin 226 extends adjacent third portion 216 and second resilient member 222. First lock pin 224 and second lock pin 226 include a shoulder. In alternative embodiments, flexible coupling 208 includes any lock pin 224, 226 that enables circuit breaker 100 to operate as described herein.

Figure 14:
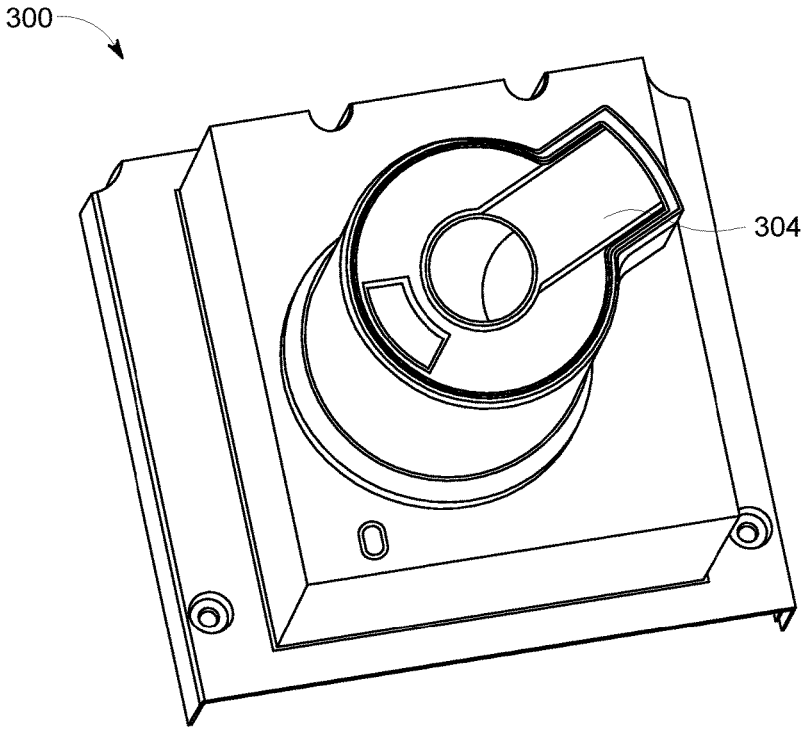
FIG. 14 is a perspective view of a portion of a circuit breaker assembly.
Figure 15:
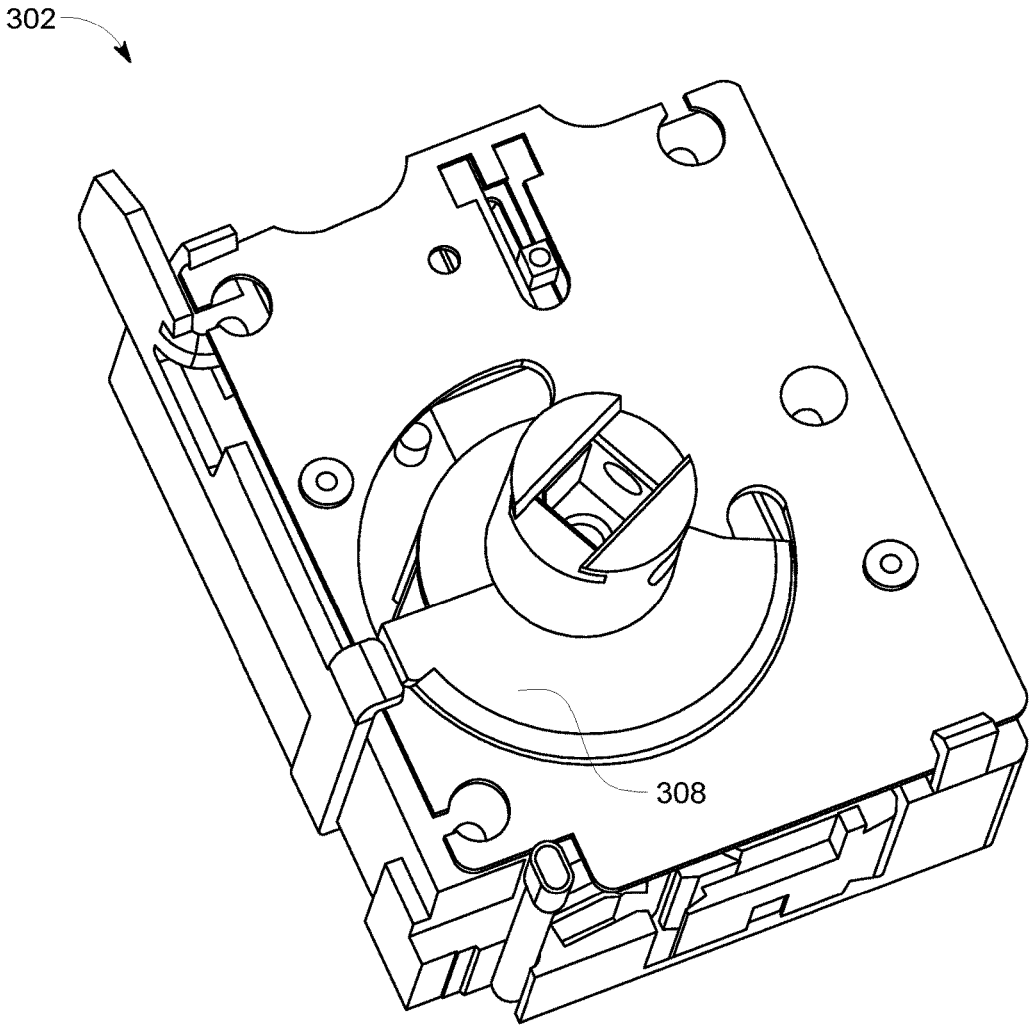
FIG. 15 is a perspective view of a gear train mechanism of the circuit breaker assembly shown in FIG. 14.
Figure 16:
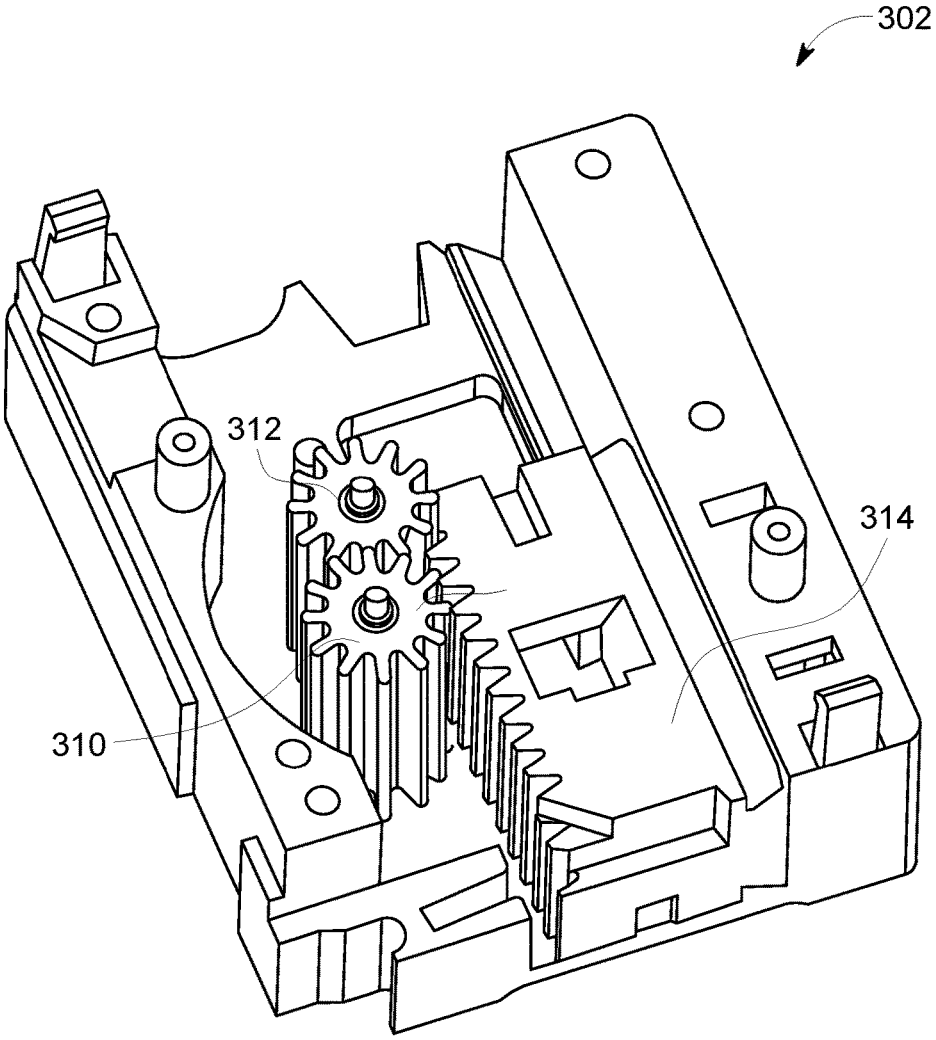
FIG. 16 is a perspective view of a portion of the gear train mechanism shown in FIG. 15.

FIG. 14 is a perspective view of a portion of a circuit breaker assembly 300. FIG. 15 is a perspective view of a gear train mechanism 302 of circuit breaker assembly 300. FIG. 16 is a perspective view of a portion of gear train mechanism 302. Circuit breaker assembly 300 includes gear train mechanism 302 and a handle 304. Gear train mechanism 302 includes a drive gear 308, a first pinion 310, a second pinion 312, and a rack 314. Rotation of handle 304 causes rotation of drive gear 308, which causes first pinion 310 to rotate. Rotation of first pinion 310 causes rotation of second pinion 312, which causes rack 314 to move linearly. Gear train mechanism 302 has a reduced size which allows circuit breaker assembly 300 to have a more compact configuration. In particular, first pinion 310 and second pinion 312 are reduced in size in comparison to first pinion 156 (shown in FIG. 4) and second pinion 158 (shown in FIG. 4). In alternative embodiments, gear train mechanism 302 is any size that enables circuit breaker assembly 300 to operate as described herein.

Figure 17:
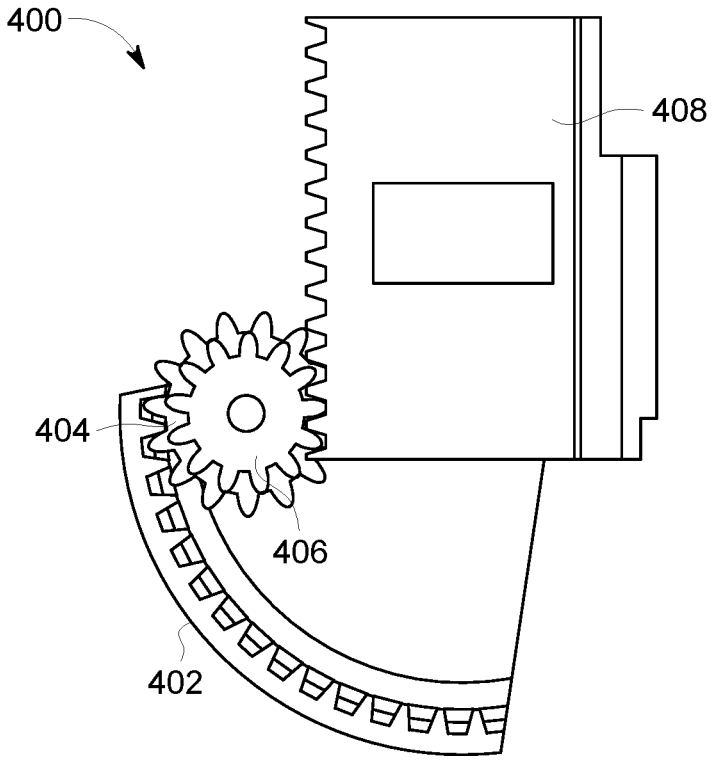
FIG. 17 is a side view of an alternative gear train mechanism for the circuit breaker assembly shown in FIG. 1A.

FIG. 17 is a side view of an alternative gear train mechanism 400 for the circuit breaker 100. Gear train mechanism 400 includes a drive gear 402, a first pinion 404, a second pinion 406, and a rack 408. First pinion 404 and second pinion 406 form a compound gear. In other words, first pinion 404 and second pinion 406 are coupled together and rotate in unison. First pinion 404 engages drive gear 402 and second pinion 406 engages rack 408. When drive gear 402 rotates, first pinion 404 and second pinion 406 are rotated. As second pinion 406 rotates, second pinion 406 causes rack 408 to move linearly. In alternative embodiments, gear train mechanism 400 includes any gears that enable gear train mechanism 400 to function as described herein.

In reference to FIGS. 1A-3, a method of manufacturing circuit breaker 100 includes coupling handle 112 to electrically insulative case 102 such that handle 112 is rotatable relative to electrically insulative case 102. Drive gear 154 is coupled to handle 112 such that drive gear 154 rotates when handle 112 rotates. The method also includes coupling first pinion 156 to drive gear 154 such that first pinion 156 rotates when drive gear 154 rotates. The method further includes coupling second pinion 158 to first pinion 156 such that second pinion 158 rotates when first pinion 156 rotates. The method also includes coupling rack 160 to second pinion 158 such that rack 160 moves linearly when second pinion 158 rotates. In some embodiments, drive gear 154, first pinion 156, and second pinion 158 are coupled to gear train housing 162.

The circuit breakers described above generally include a handle that rotates relative to an electrically insulative case. The handle is coupled to a gear train mechanism, which includes a drive gear, a plurality of pinions, and a sliding rack. In some embodiments, the plurality of pinions are positioned within an outer circumference of the drive gear to reduce the space occupied by the gear train mechanism. The gear train mechanism translates the rotational movement of the handle into linear movement of the sliding rack. The sliding rack causes actuation of a switch of the circuit breaker. In some embodiments, the handle includes a visual indicator mechanism to indicate the operating status of the circuit breaker. In further embodiments, the circuit breaker includes an interlock that selectively engages a biasing mechanism. Also, in some embodiments, the circuit breaker includes a gear lock mechanism that directly engages a drive gear.

An exemplary technical effect of the methods, systems, and apparatus described herein includes at least one of: (a) reducing cost and time required to manufacture circuit breakers; (b) decreasing torque required to rotate circuit breaker handles; (c) increasing reliability of operating mechanisms of circuit breakers; (d) providing consistent indication of the status of circuit breakers; and (e) reducing the size of circuit breakers.

Exemplary embodiments of circuit breakers and methods of manufacturing circuit breakers are described above in detail. The circuit breakers and methods are not limited to the specific embodiments described herein but, rather, components of the circuit breakers and/or operations of the methods may be utilized independently and separately from other components and/or operations described herein. Further, the described components and/or operations may also be defined in, or used in combination with, other systems, methods, and/or devices, and are not limited to practice with only the circuit breakers and systems described herein.

The order of execution or performance of the operations in the embodiments of the disclosure illustrated and described herein is not essential, unless otherwise specified. That is, the operations may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An electrically insulative case for a circuit breaker, said case comprising:

a door arranged to move between an opened position and a closed position;

a rack mechanism arranged to move between an ON position and an OFF position, wherein said rack mechanism is arranged to actuate an operating switch of the circuit breaker such that a conductive path is closed when said rack mechanism is in the ON position and is open when said rack mechanism is in the OFF position; and an interlock arranged to selectively inhibit said door moving between the opened position and the closed position, said interlock comprising:

a plunger arranged to move between a locked position and an unlocked position, said door inhibited from moving to the opened position when said plunger is in the locked position;

an engagement mechanism coupled to said plunger, said engagement mechanism arranged to move between a first position in which said engagement mechanism is spaced from said rack mechanism and a second position in which said engagement mechanism is engaged with said rack mechanism, wherein said plunger is arranged to move to the locked position when said engagement mechanism is in the second position and said rack mechanism is in the ON position; and a first biasing member arranged to bias said plunger towards the unlocked position;

wherein said rack mechanism includes a second biasing member engaged with said engagement mechanism when said engagement mechanism is in the second position and said rack mechanism is in the ON position.

2. The electrically insulative case in accordance with claim 1, further comprising a gear train housing, wherein said first biasing member is coupled to said plunger and said gear train housing.

3. The electrically insulative case in accordance with claim 1, wherein said second biasing member has a biasing force that is greater than a biasing force of said first biasing member.

4. The electrically insulative case in accordance with claim 1, wherein said second biasing member is spaced from said engagement mechanism when said engagement mechanism is in the second position and said rack mechanism is in the OFF position.

5. The electrically insulative case in accordance with claim 1, wherein said interlock further comprises an actuator that is coupled to said engagement mechanism and extends at least partially on an exterior of said door, wherein said actuator is arranged to cause said engagement mechanism to move between the first position and the second position.

6. The electrically insulative case in accordance with claim 1, wherein said plunger is movably coupled to said door, said plunger extending on an exterior of said door when said plunger is in the unlocked position.

7. The electrically insulative case in accordance with claim 1, wherein said engagement mechanism is at least partially concealed in said plunger when said engagement mechanism is in the first position, and wherein said engagement mechanism extends from said plunger when said engagement mechanism is in the second position.

8. The electrically insulative case in accordance with claim 1, wherein said engagement mechanism is accessible from an exterior of said case to allow an operator to move said engagement mechanism between the first position and the second position.

9. The electrically insulative case in accordance with claim 1, wherein said plunger is accessible from an exterior of said case to allow an operator to move said plunger between the unlocked position and the locked position.

10. A circuit breaker comprising:

a door arranged to move between an opened position and a closed position;

an operating switch arranged to move between an ON position and an OFF position, wherein a conductive path is closed when said operating switch is in the ON position and is open when said operating switch is in the OFF position;

a gear train mechanism coupled to said operating switch, wherein said gear train mechanism is arranged to induce said operating switch to move between the ON position and the OFF position; and an interlock that is arranged to selectively inhibit said door from moving between the opened position and the closed position, said interlock comprising:

a plunger arranged to move between a locked position and an unlocked position, said door inhibited from moving to the opened position when said plunger is in the locked position; and an engagement mechanism coupled to said plunger, said engagement mechanism arranged to move between a first position in which said engagement mechanism is spaced from said gear train mechanism and a second position in which said engagement mechanism is engaged with said gear train mechanism, wherein said plunger is arranged to move to the locked position when said engagement mechanism is in the second position and said operating switch is in the ON position.

11. The circuit breaker in accordance with claim 10, wherein said engagement mechanism is accessible from an exterior of said circuit breaker to allow an operator to move said engagement mechanism between the first position and the second position.

12. The circuit breaker in accordance with claim 10 further comprising a first biasing member arranged to bias said plunger towards the unlocked position.

13. The circuit breaker in accordance with claim 12 further comprising a gear train housing, wherein said first biasing member is coupled to said plunger and said gear train housing.

14. The circuit breaker in accordance with claim 12, wherein said gear train mechanism includes a second biasing member engaged with said engagement mechanism.

15. The circuit breaker in accordance with claim 14, wherein said gear train mechanism further includes a rack mechanism, said second biasing member coupled to said rack mechanism.

16. A method of manufacturing a circuit breaker, said method comprising:

coupling a door to an electrically insulative case, wherein the door is arranged to move between an opened position and a closed position;

coupling a handle to the door to enable an operator to move the door between the opened position and the closed position;

coupling a gear train mechanism to the handle, wherein the gear train mechanism includes a rack mechanism arranged to actuate an operating switch of the circuit breaker such that a conductive path is closed when the rack mechanism is in an ON position and is open when the rack mechanism is in an OFF position;

coupling a plunger to the door, the plunger arranged to move between a locked position and an unlocked position, wherein the door is inhibited from moving to the opened position when the plunger is in the locked position; and coupling an engagement mechanism to the plunger, the engagement mechanism arranged to move between a first position in which the engagement mechanism is spaced from the rack mechanism and a second position in which the engagement mechanism is engaged with the rack mechanism, wherein the plunger is arranged to move to the locked position when the engagement mechanism is in the second position and the rack mechanism is in the ON position.

17. The method in accordance with claim 16, further comprising coupling a first biasing member to the plunger to bias the plunger toward the unlocked position.

18. The method in accordance with claim 16, further comprising coupling a second biasing member to the rack mechanism such that the second biasing member is engaged with the engagement mechanism when the engagement mechanism is in the second position and the rack mechanism is in the ON position, wherein the second biasing member has a biasing force that is greater than a biasing force of the first biasing member.

* * * * *